United States Patent [19]

Halmstad et al.

[11] Patent Number: 4,861,290

[45] Date of Patent: Aug. 29, 1989

[54] ALUMINUM ELECTRICAL CONNECTOR WITH THREADED OPENING HAVING ELECTROPLATED LAYER OF UNIFORM THICKNESS

[75] Inventors: Terrence R. Halmstad, Brookfield; Steven R. Schachameyer, Whitefish Bay, both of Wis.

[73] Assignee: Eaton Corporation, Cleveland, Ohio

[21] Appl. No.: 130,738

[22] Filed: Dec. 9, 1987

[51] Int. Cl.[4] ..... H01R 4/30

[52] U.S. Cl. ..... 439/810; 204/33

[58] Field of Search ..... 204/33, 38.4, 40, 49, 204/23; 439/810

[56] References Cited

U.S. PATENT DOCUMENTS

| | | | |
|---|---|---|---|
| 2,745,799 | 5/1956 | Patrie | 204/33 |
| 3,667,991 | 6/1972 | Miller | 204/38.4 |
| 3,726,771 | 4/1973 | Coll-Palagos | 204/38.4 |
| 3,915,667 | 10/1975 | Ricks | 204/33 |
| 4,042,466 | 8/1977 | Anselrode | 204/11 |
| 4,126,522 | 11/1978 | Edlund | 204/33 |
| 4,196,061 | 4/1980 | Satee | 204/33 |
| 4,235,648 | 4/1980 | Richardson | 148/6.27 |
| 4,437,951 | 3/1984 | Bissot et al. | 204/98 |

OTHER PUBLICATIONS

"Stable Strike for Plating on Aluminum", Leo Missel et al., Metal Finishing, Aug. 1981, pp. 37–42.

"Degradation of Cu-Sn/Pb Surface Layers of Aluminum Conductors by the Action of an Electric Current", Silveira et al., IEEE Holms's Conference, Chicago, Ill, Sep. 17–21, 1984, pp. 113–117, Library of Congress Card No. A58-1550, Book Crafters, Inc.

"Evaluation of Improved Reliability for Plated Aluminum Extrusions", S. R. Schachameyer et al., Plating and Surface Finishing, Oct. 1982, pp. 50–55.

*Primary Examiner*—Frank Gonazalez

*Attorney, Agent, or Firm*—Andrus, Sceales, Starke & Sawall

[57] ABSTRACT

An aluminum electrical connector lug (2) has a lug body (4) with a threaded opening (12) having an electroplated coating layer (22) with substantially the same thickness at the roots (16) as at the crowns (18).

5 Claims, 1 Drawing Sheet

FIG. 1
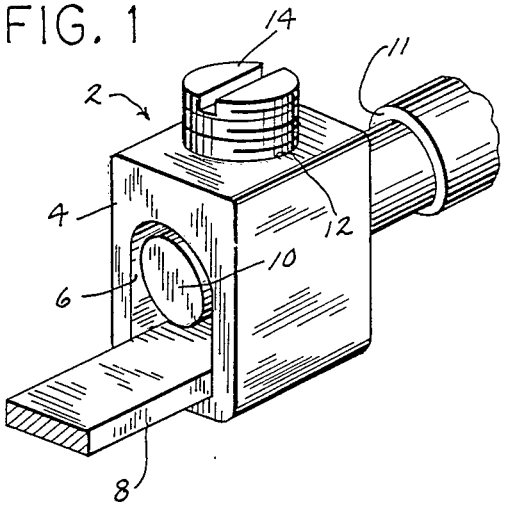
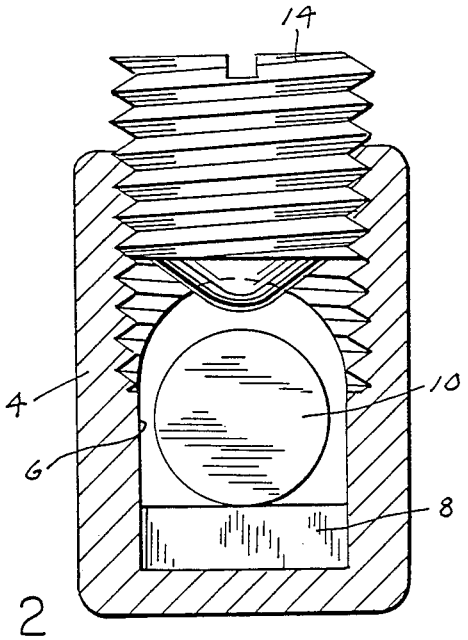
FIG. 2
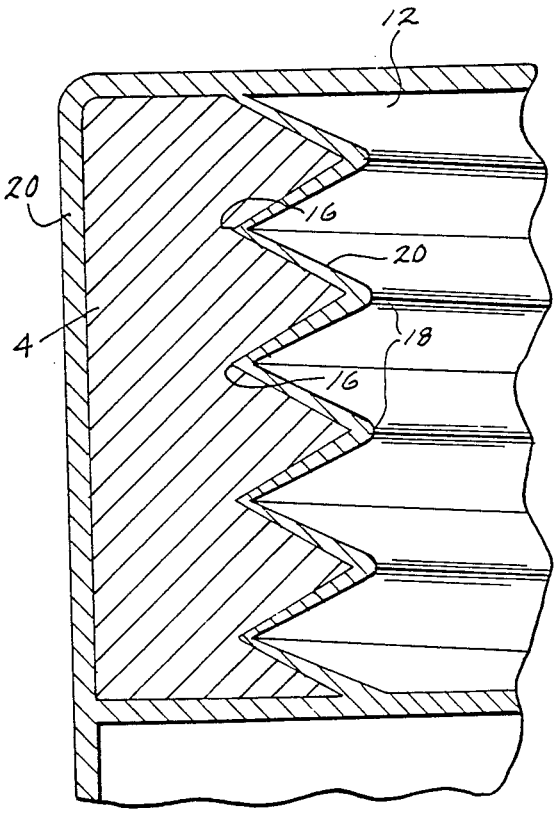
FIG. 3
PRIOR ART
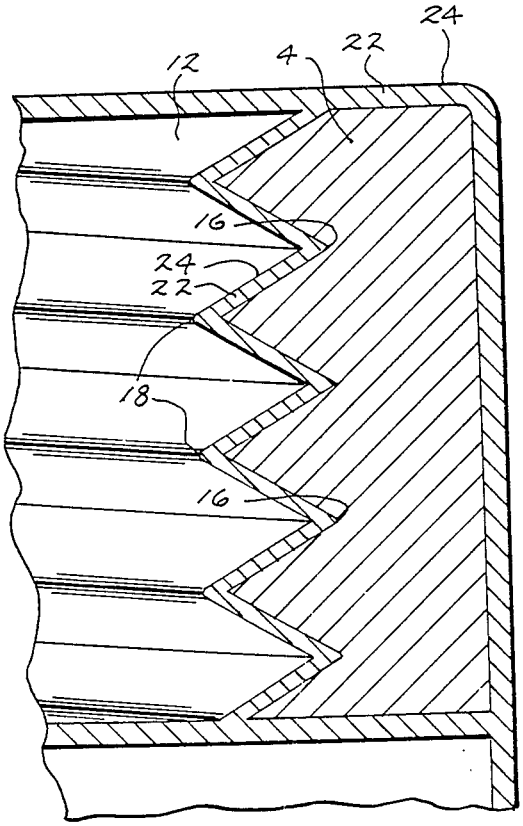
FIG. 4

ALUMINUM ELECTRICAL CONNECTOR WITH THREADED OPENING HAVING ELECTROPLATED LAYER OF UNIFORM THICKNESS

BACKGROUND AND SUMMARY

The invention relates to aluminum electrical terminal connectors, including connector lugs having a threaded opening for receiving a clamping screw which is tightened down to hold an electrical terminal in the lug.

The use of aluminum in electrical distribution systems as an electrical conductor is known. Aluminum is lighter and more economical than copper. However, aluminum has certain disadvantages which have hindered its total acceptance as a substitute for copper. One of these disadvantages is the necessity to plate the aluminum to prevent the formation of a dielectric oxide layer thereon. Another disadvantage is that in-service temperature cycling due to on/off electrical current flow causes changes in the physical size of the aluminum conductor as a result of thermal expansion and contraction. This phenomena causes joined parts to creep, thereby loosening clamped connections and creating increased voltage drops at the respective connections, which in turn may cause potentially dangerous elevated temperatures at such connections.

The above noted problems are particularly manifested in aluminum connector lugs, especially when such lugs are utilized to connect aluminum wire conductors. The lug includes a body having a main opening for receiving one or more electrical terminals, and a transverse threaded opening for receiving a clamping screw which is tightened down to engage and frictionally hold the terminals in the lug body. Sufficient clamping pressure should be applied to penetrate any oxide layer formed on the terminal. The plating for the connector lug should be durable enough to withstand such clamping pressure.

If the plating on both the lug and the terminal breaks down, an aluminum to aluminum connection occurs. While this initially provides a connection with low electrical resistance, thermal expansion may create relative movement to expose bare aluminum, which exposed surface will be subject to oxidation, which increases the voltage drop at the connection.

It has been found that a problem associated with plating of aluminum electrical connector lugs is uniformity of the coating along the threads in the threaded opening. Prior plating methods do not provide uniform plating thickness at the roots and crowns of the thread. The plating at the crowns is substantially thicker than the plating at the roots. This provides a condition which adversely affects the mechanical cooperation of the threads of the screw with the threads in the threaded opening of the lug body.

Another problem with nonuniform thickness of the plating layer along the lug threads is the adverse affect on electrical current distribution. The screw typically carries as much as 15% of the load current. It is desired to at least maintain this load current and resultant heat distribution. A nonuniform coating layer provides varying electrical resistance paths and hence may diminish the load current share through the screw, which is undesirable.

It is believed that prior attempts to satisfactorily electroplate an aluminum connector lug failed for various reasons. The aluminum connector lug is typically provided with a deoxidation pretreatment protective layer, such as a zinc or tin film, for example by a zincate process. The connector was then nickel plated. It is believed that in some instances the nickel plating bath was too acidic, e.g. 3 or 4 pH, and rapidly dissolved the zincate layer and then attacked the aluminum surface before the nickel could be electrolytically plated thereon, which exaggerated the problems already inherent in electroplating low current density areas such as the roots.

In the present invention, it has been found that acetate buffered nickel glycolate electroplating provides a solution to the above noted problem. This type of electroplating is known in the art for a strike application for capstan drive motors, "Stable Strike for Plating on Aluminum", Missel et al, *Metal Finishing*, Aug. 1981, pages 37–42. In the present invention, it has been found that instead of using the nickel glycolate as a strike, such process and bath may also be used to build up layer thickness in aluminum connector lugs, and it has been found that the coated layer has uniform thickness at the roots and crowns of the lug threaded opening It is believed that the acetate buffered nickel glycolate successfully provides uniform thickness plating at the roots and crowns because of reduced acidity of the nickel electrolyte reacting more slowly with the zincate layer. It is also believed that such bath provides low cathodic efficiency in high current density regions, also slowing the process, and providing a more uniformly thick plating at the roots and crowns. The crowns are high current density regions and the roots are low current density regions during electroplating. It is also believed that a low cathodic efficiency near neutral nickel electrolyte dissolves the zincate layer at a much slower or negligible rate and permits immediate deposition of nickel on the zincate layer without the aluminum being attacked by the otherwise highly acidic electrolyte.

BRIEF DESCRIPTION OF THE DRAWINGS

FIG. 1 is a perspective view of an aluminum electrical terminal connector lug.

FIG. 2 is an enlarged sectional view of the structure of FIG. 1.

FIG. 3 is an enlarged fragmentary sectional view of a lug with differential plating thickness at the roots and crowns, of the threaded opening, illustrating the prior art.

FIG. 4 is an enlarged fragmentary sectional view of a lug with uniform plating thickness at the roots and crowns of the threaded opening, in accordance with the invention.

DETAILED DESCRIPTION

FIG. 1 shows an aluminum electrical connector lug 2 having a lug body 4 with a main opening 6 for receiving one or more electrical terminals such as flat conductor 8 and round wire conductor 10 having insulating sheath 11. The lug body has a transverse threaded opening 12 receiving a clamping screw 14 which is tightened down to hold conductor 10 against conductor 8 in the lug.

The threads of opening 12 are formed by a series of roots 16 and crowns 18, as shown in FIG. 3 in which screw 14 has been removed. FIG. 3 shows prior electroplated lug structure with electroplated coating layer 20 being thinner at roots 16 than at crowns 18. FIG. 4 shows the connector lug in accordance with the invention having electroplated coating layer 22 with substantially the same thickness at roots 16 as at crowns 18. Screw 14 is also aluminum and the thread thereof is formed by a series of roots and crowns, and an electroplated coating layer is provided on the screw having substantially the same thickness at the screw roots as at the screw crowns. The electroplated layers are provided by immersing lug body 4 and clamping screw 14 in disassembled condition in a near-neutral low efficiency nickel electrolyte such as an acetate buffered nickel glycolate, which bath is known in the art, for example the above noted Missel et al article.

The aluminum lug body 4 and clamping screw 14 are initially pretreated with a zincate process, as known in the art, to provide a layer of zincate which acts as a deoxidation pretreatment protective layer on the bare aluminum. Alternatively, other layers of zinc or a layer of tin may be used for such deoxidation protective layer. Lug body 4 and clamping screw 14 are then immersed in the acetate buffered nickel glycolate bath for an immersion time sufficient to build up a nickel film at least 0.1 to 0.2 mil. Immersion time is 15 to 25 minutes. The nickel electrolyte preferably has a pH value in the range of 6.2 to 6.8. Unlike prior acetate buffered nickel glycolate processes having immersion times of about five minutes and coating thicknesses of about 0.03 mil, the connector lug processing has a substantially longer immersion time and a substantially thicker plated coating. It has been found that the resultant thicker coating is of uniform thickness including substantially the same thickness at roots 16 as at crowns 18. After the initial zincate process and the nickel plating, lug body 4 and screw 14 are tin plated with a thin tin coating 24.

A particularly desirable aspect of the lug of FIG. 4 is the elimination of an inner copper or copper alloy layer altogether. This eliminates a source of copper atoms which might otherwise be subject to migration: "Degradation of Cu-Sn/Pb Surface Layers on Aluminum Conductors by the Action of an Electric Current", Silveira et al, IEEE Holm's Conference, Chicago, Ill. Sept. 17–21 , 1984, pp. 113–117, Library of Congress Card No. A58-1550, Book Crafters, Inc.; "Evaluation of Improved Reliability for Plated Aluminum Extrusions", Schachameyer et al, *Plating and Surface Finishing,* Oct., 1982, pages 50–55; and Ricks U.S. Pat. No. 3,915,667.

Cycling tests were conducted at electrical connections utilizing plated aluminum connector lugs in accordance with the invention and compared against the type of plated connector lugs shown in FIG. 3. Two hundred amps were applied for one hour on and one hour off cycles. The temperature rise of the lug of FIG. 3 was more than 80° C. over ambient. The temperature rise of the lug of FIG. 4 was less than 10° C. over ambient.

It is recognized that various equivalents, alternatives and modifications are possible within the scope of the appended claims.

We claim:

1. An aluminum electrical connector having a connector body with a threaded opening receiving a clamping screw which is tightened down to hold one or more electrical terminals in said connector body, the threads of said opening being formed by a series of roots and crowns, and comprising an electroplated coating layer on said connector body having substantially the same thickness at said roots as at said crowns.

2. The invention according to claim 1 wherein said clamping screw is also aluminum and the threads thereof formed by a series of roots and crowns, and comprising an electroplated coating layer on said clamping screw having substantially the same thickness at said screw roots as at said screw crowns.

3. The invention according to claim 1 wherein said thickness of said layer is about 0.1 to 0.2 mil.

4. The invention according to claim 3 wherein said electroplated coating layer is a near neutral nickel glycolate layer.

5. A zincate processed aluminum electrical connector having a connector body with a threaded opening receiving a clamping screw which is tightened down to hold one or more electrical terminals in said connector body, the threads of said opening being formed by a series of roots and crowns. and comprising in combination a near neutral nickel glycolate layer on said zincate processed aluminum without an inner copper layer therebetween, and with an outer layer of tin on said near neutral nickel glycolate layer, said near neutral nickel glycolate layer having substantially the same thickness at said roots as at said crowns.

* * * * *